US011355877B2

(12) United States Patent
Costello et al.

(10) Patent No.: US 11,355,877 B2
(45) Date of Patent: Jun. 7, 2022

(54) POWER CONNECTOR SYSTEM FOR CIRCUIT CARD ASSEMBLY

(71) Applicant: TE CONNECTIVITY CORPORATION, Berwyn, PA (US)

(72) Inventors: Brian Patrick Costello, Scotts Valley, CA (US); Matthew Schumacher, Magnolia, TX (US)

(73) Assignee: TE CONNECTIVITY SERVICES GMBH, Schaffhausen (CH)

( * ) Notice: Subject to any disclaimer, the term of this patent is extended or adjusted under 35 U.S.C. 154(b) by 0 days.

(21) Appl. No.: 16/878,060

(22) Filed: May 19, 2020

(65) Prior Publication Data

US 2021/0013649 A1 Jan. 14, 2021

Related U.S. Application Data

(60) Provisional application No. 62/872,932, filed on Jul. 11, 2019.

(51) Int. Cl.

| | |
|---|---|
| ***H01R 12/75*** | (2011.01) |
| ***H01R 12/71*** | (2011.01) |
| ***H01R 12/70*** | (2011.01) |
| ***H01R 13/627*** | (2006.01) |

(52) U.S. Cl.

CPC ..... *H01R 12/75* (2013.01); *H01R 12/7088* (2013.01); *H01R 12/712* (2013.01); *H01R 13/6272* (2013.01)

(58) Field of Classification Search

CPC ..... H01R 27/00; H01R 23/7073; H01R 23/7068; H01R 12/75; H01R 12/712; H01R 12/7088; H01R 13/6272

USPC ..... 439/630, 79

See application file for complete search history.

(56) References Cited

U.S. PATENT DOCUMENTS

| | | | | |
|---|---|---|---|---|
| 6,027,375 | A * | 2/2000 | Wu | H01R 13/502 439/607.02 |
| 6,666,695 | B1 * | 12/2003 | Yeh | H01R 12/721 439/541.5 |
| 6,746,281 | B1 * | 6/2004 | Zhang | H01R 12/725 439/637 |
| 7,481,657 | B2 * | 1/2009 | Ng | H01R 13/516 439/637 |
| 9,979,127 | B2 | 5/2018 | Zhang et al. | |
| D832,788 | S | 11/2018 | Li et al. | |
| D837,737 | S | 1/2019 | Li et al. | |
| 2005/0272303 | A1 * | 12/2005 | Wu | H01R 43/24 439/499 |

(Continued)

*Primary Examiner* — Gary F Paumen

(57) ABSTRACT

A power connector system for a circuit card assembly includes a board power connector and a cable power connector coupled to the board power connector. The board power connector includes a board housing having cavities that hold power contacts and signal contact channels on the bottom that hold signal contacts. The cable power connector has a cable housing having contact silos holding cable power contacts terminated to power cables. The contact silos and the cable power contacts are received in the cavities of the board housing to mate the cable power contacts with the board power contacts. The cable housing includes a platform below the contact silos holding cable signal contacts at the bottom of the cable housing outside of the contact silos for mating with the board signal contacts when the cable power connector is mated with the board power connector.

20 Claims, 7 Drawing Sheets

(56) References Cited

U.S. PATENT DOCUMENTS

| | | | | |
|---|---|---|---|---|
| 2008/0207029 | A1* | 8/2008 | Defibaugh | H01R 13/46 439/206 |
| 2010/0093222 | A1* | 4/2010 | He | H01R 12/712 439/638 |
| 2011/0136389 | A1* | 6/2011 | Huang | H01R 24/78 439/638 |
| 2012/0115371 | A1* | 5/2012 | Chuang | H01R 12/724 439/660 |
| 2013/0059479 | A1* | 3/2013 | Ho | H01R 27/02 439/639 |
| 2015/0188262 | A1* | 7/2015 | Wu | H01R 13/6593 439/607.55 |
| 2015/0303610 | A1* | 10/2015 | Hou | H01R 24/62 439/660 |
| 2016/0111834 | A1* | 4/2016 | Chen | H01R 27/02 439/676 |

* cited by examiner

POWER CONNECTOR SYSTEM FOR CIRCUIT CARD ASSEMBLY

CROSS REFERENCE TO RELATED APPLICATIONS

This application claims benefit to U.S. Provisional Application No. 62/872,932, filed 11 Jul. 2019, titled "POWER CONNECTOR SYSTEM FOR CIRCUIT CARD ASSEMBLY", the subject matter of which is herein incorporated by reference in its entirety.

BACKGROUND OF THE INVENTION

The subject matter herein relates generally to power connector systems for circuit card assemblies.

Circuit card assemblies have components that require power to operate. Typically, power is delivered to the circuit card across the interface with the card edge connector that receives the circuit card. However, providing power contacts at the interface increases the number of contacts needed at the interface. When adhering to standard interfaces, the number of contacts may not be increased to accommodate a larger power requirement. Additionally, the contact pads are typically small and thus have low current capacity. To overcome the problems with conventional circuit card assemblies, some circuit card assemblies provide a separate power connector mounted to the circuit card that mates with a cable power connector to supply power to the circuit card. There is a need to provide signaling with the cable power connector. However, known cable power connectors having signal contacts have an increased profile and footprint. The addition of the signal contacts increases the width and/or height of the cable connector and the board mounted connector, which reduces airflow across the circuit card assembly and reduces the real estate on the circuit card for other electrical components.

A need remains for a low profile, small footprint power connector system for a circuit card assembly having signal contacts and power contacts.

BRIEF DESCRIPTION OF THE INVENTION

In one embodiment, a power connector system for a circuit card assembly is provided. The power connector system includes a board power connector having a board housing including a top, a bottom, a front and a rear. The board housing includes cavities open at the front. The bottom is configured to be mounted to a circuit card of the circuit card assembly. The board housing includes signal contact channels on the bottom. The board power connector includes board power contacts received in corresponding cavities. Each board power contact includes a mating end and a terminating end. The terminating ends of the board power contacts are configured to be terminated to the circuit card. The board power connector includes board signal contacts received in corresponding signal contact channels. Each board signal contact includes a mating end and a terminating end. The terminating ends of the signal contact channels are configured to be terminated to the circuit card. The mating ends of the board signal contacts are exposed along the bottom of the board housing. The power connector system includes a cable power connector configured to be mated to the board power connector. The cable power connector has a cable housing including a top, a bottom, a front and a rear. The cable power connector includes power cables extending from the rear. The cable housing includes contact silos at the front. the cable power connector includes cable power contacts held in corresponding contact silos. The cable power contacts are terminated to corresponding power cables. The contact silos and the cable power contacts are received in the cavities of the board housing to mate the cable power contacts with the board power contacts. The cable power connector includes cable signal contacts arranged at the bottom of the cable housing outside of the contact silos for mating with the board signal contacts when the cable power connector is mated with the board power connector.

In another embodiment, a power connector system for a circuit card assembly is provided. The power connector system includes a board power connector configured to be mounted to a circuit card of the circuit card assembly and configured to be mated with a cable power connector. The board power connector includes a board housing including a top, a bottom, a front and a rear. The board housing includes cavities open at the front. The bottom is configured to be mounted to the circuit card of the circuit card assembly. The board housing includes signal contact channels on the bottom. Board power contacts are received in corresponding cavities. Each board power contact includes a mating end and a terminating end. The terminating ends of the board power contacts are configured to be terminated to the circuit card. The mating ends of the board power contacts are configured to be mated to cable power contacts of the cable power connector. Board signal contacts are received in corresponding signal contact channels. Each board signal contact includes a mating end and a terminating end. The terminating ends of the signal contact channels are configured to be terminated to the circuit card. The mating ends of the board signal contacts are exposed along the bottom of the board housing for mating with cable signal contacts of the cable power connector.

In a further embodiment, a power connector system for a circuit card assembly is provided. The power connector system includes a cable power connector configured to be mated to a board power connector mounted to the circuit card assembly. The cable power connector includes a cable housing including a top, a bottom, a front and a rear. The cable housing includes contact silos at the front configured to be received in cavities of the board power connector. The cable housing includes a platform at the bottom spaced apart from the contact silos by a gap. The gap is configured to receive a bottom wall of a board housing of the board power connector. Cable power contacts are held in corresponding contact silos and are configured to be received in the cavities of the board power connector with the contact silos. The cable power contacts include mating ends configured to be mated to board power contacts of the board power connector, the cable power contacts including terminating ends. Power cables are terminated to the terminating ends of the cable power contacts and extending from the rear. Cable signal contacts are arranged at the bottom of the cable housing along the platform. The cable signal contacts include mating ends and terminating ends. The mating ends are exposed along the platform for mating with board signal contacts of the board power connector. Signal cables are terminated to terminating ends of the cable signal contacts.

DETAILED DESCRIPTION OF THE INVENTION

Figure 1:
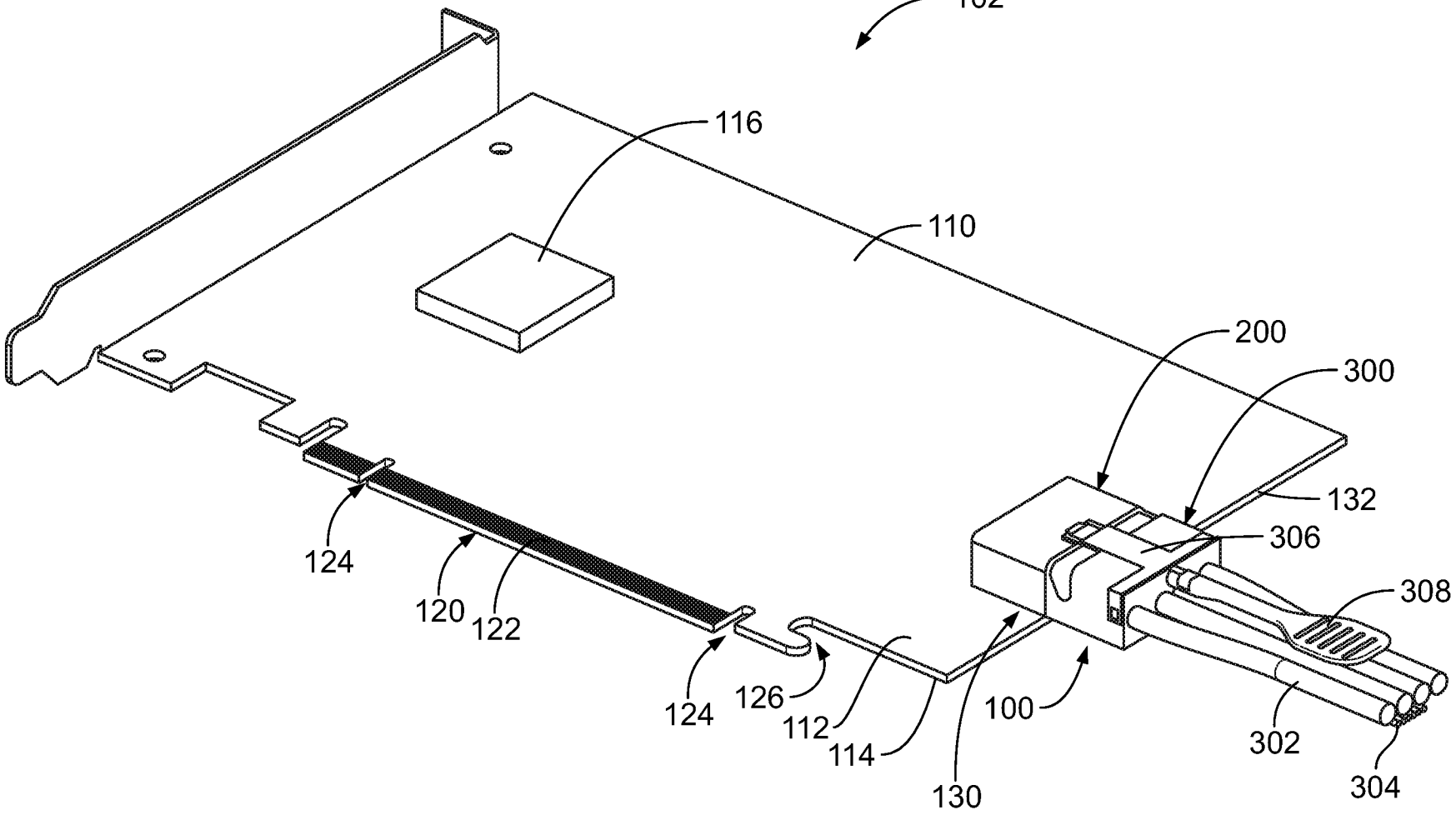
FIG. 1 is a top perspective view of a power connector system for a circuit card assembly in accordance with an exemplary embodiment.
Figure 2:
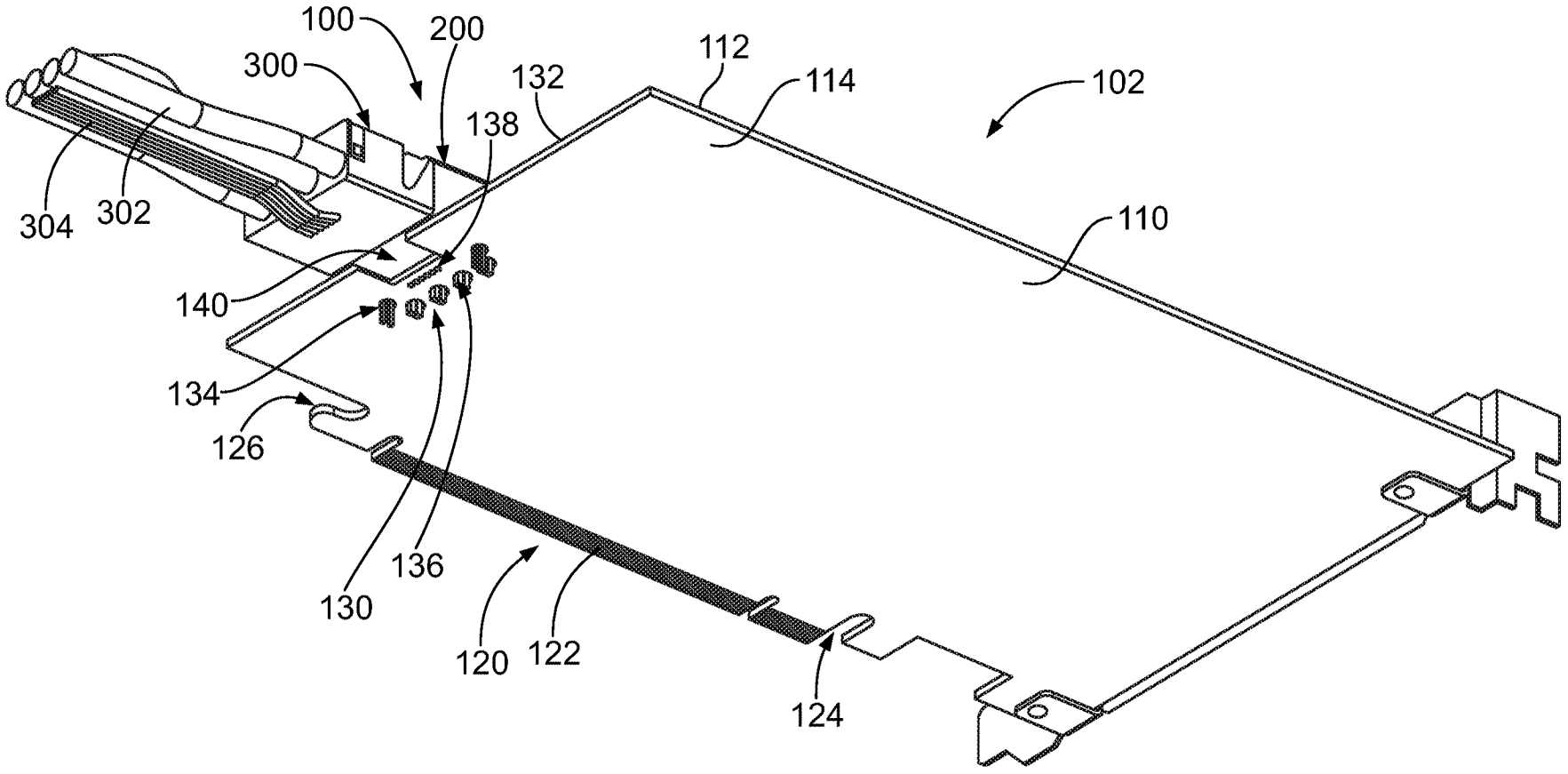
FIG. 2 is a bottom perspective view of the power connector system for the circuit card assembly in accordance with an exemplary embodiment.

FIG. 1 is a top perspective view of a power connector system 100 for a circuit card assembly 102 in accordance with an exemplary embodiment. FIG. 2 is a bottom perspective view of the power connector system 100 for the circuit card assembly 102 in accordance with an exemplary embodiment. The power connector system 100 is a cable to board power delivery system. The power connector system 100 provides power to the circuit card assembly 102. In the illustrated embodiment, the circuit card assembly 102 is a peripheral component interconnect express (PCIe) assembly; however, the circuit card assembly 102 may be another type of electrical assembly in alternative embodiments.

The circuit card assembly 102 includes a circuit card 110 having a top surface 112 and a bottom surface 114. The circuit card 110 is a printed circuit board having circuits defined by traces, vias, pads, and the like of the circuit card 110. The circuit card assembly 102 includes one or more electrical components 116 mounted to the circuit card 110, such as processors, memories, and the like. In an exemplary embodiment, the circuit card 110 includes a card edge 120 configured to be received in a card slot of a card edge connector (not shown). The circuit card 110 includes contact pads 122 at the card edge 120 configured to be electrically connected to the card edge connector. The circuit card 110 includes guide slots 124 to guide mating with the card edge connector. The circuit card 110 includes a latching feature 126 for latchably coupling the circuit card 110 to the card edge connector.

The circuit card 110 includes a mounting area 130, such as along a side edge 132 of the circuit card 110. The power connector system 100 is electrically connected to the circuit card 110 at the mounting area 130. The power connector system 100 provides power to the circuit card assembly 102. In an exemplary embodiment, the circuit card 110 includes mounting openings 134 for mounting a connector of the power connector system 100 to the circuit card 110, such as using mounting tabs, fasteners, or other securing features. The circuit card 110 includes power conductors 136 configured to be electrically connected to power contacts of the power connector and signal conductors 138 configured to be electrically connected to signal contacts of the power connector. In the illustrated embodiment, the power conductors 136 and the signal conductors 138 include plated vias through the circuit card 110. Other types of conductors may be used in alternative embodiments, such as solder pads or contacts terminated to the circuit card 110.

In an exemplary embodiment, the circuit card 110 includes a window 140 at the mounting area 130. The window 140 receives a portion of an electrical connector of the power connector system 100. The window 140 provides a space to receive the electrical connector for mating with the circuit card assembly 102 and/or the electrical connector mounted to the circuit card 110. The window 140 is a notch formed at the edge 132 in the illustrated embodiment.

The power connector system 100 includes a board power connector 200 and a cable power connector 300. The cable power connector 300 includes power cables 302 and signal cables 304 configured to be electrically connected to the board power connector 200. The cable power connector 300 includes a latch 306 for securing the cable power connector 300 to the board power connector 200. The latch 306 includes a tether 308 for releasing the latch 306. The board power connector 200 is mounted to the circuit card 110 at the mounting area 130. In an exemplary embodiment, the board power connector 200 is a right angle connector having a mating end configured to be mated to the cable power connector 300 and a mounting end perpendicular to the mating end configured to be mounted to the circuit card 110. Other types of connectors may be used in alternative embodiments. In an exemplary embodiment, the board power connector 200 and the cable power connector 300 have low-profiles for increased airflow and tighter packaging of electrical components.

Figure 3:
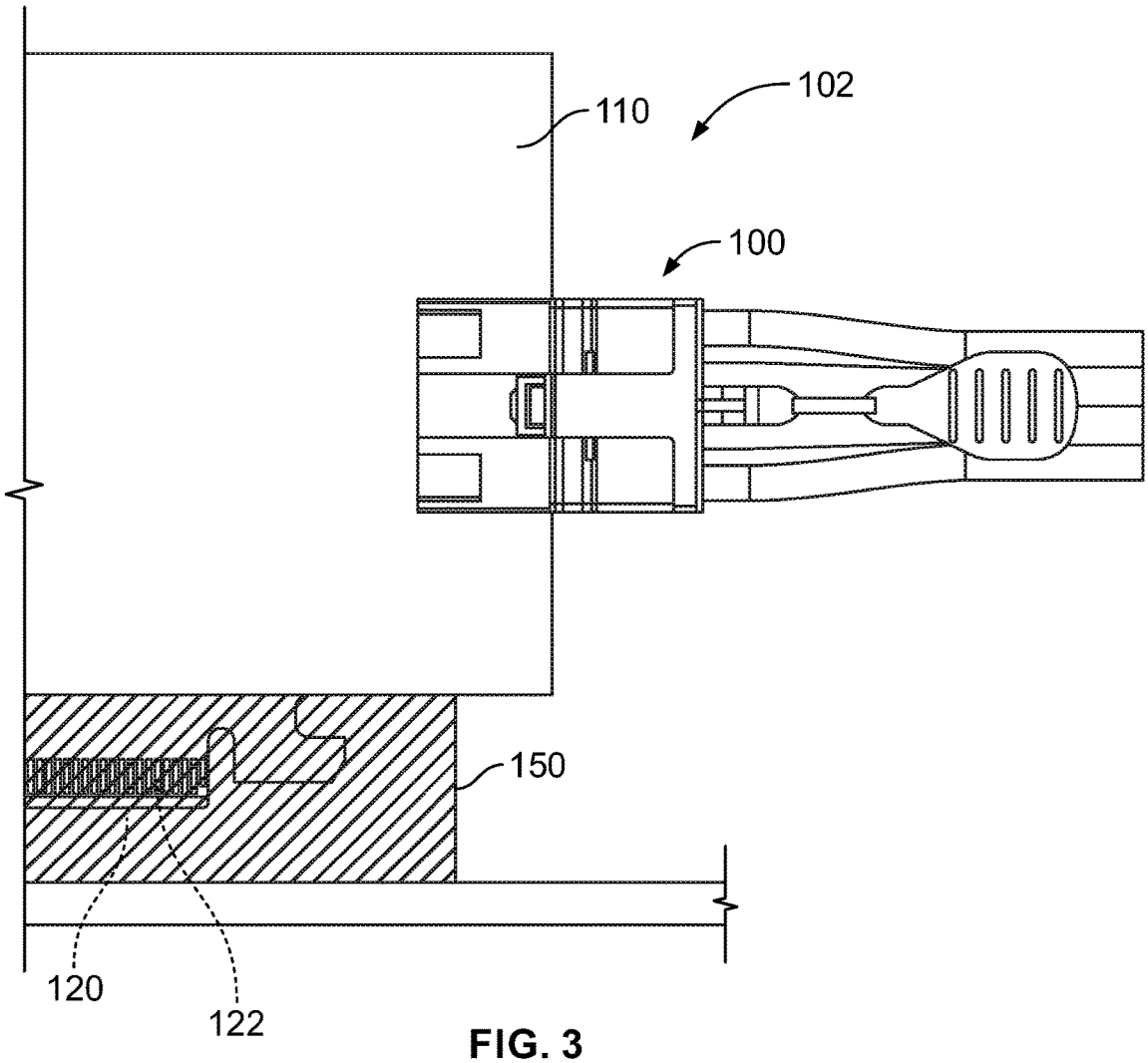
FIG. 3 is a top view of the power connector system mounted to the circuit card assembly in accordance with an exemplary embodiment.
Figure 4:
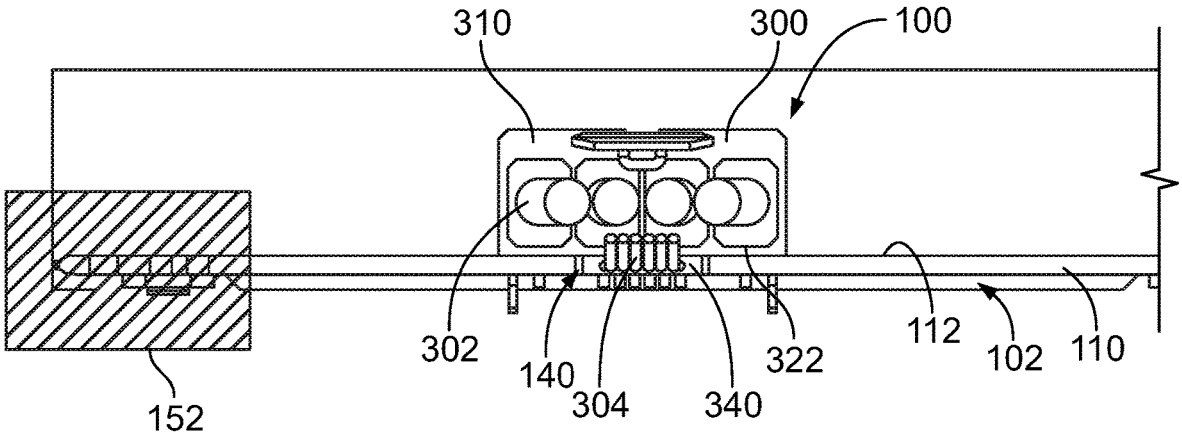
FIG. 4 is an end view of the power connector system mounted to the circuit card assembly in accordance with an exemplary embodiment.

FIG. 3 is a top view of the power connector system 100 mounted to the circuit card assembly 102. FIG. 4 is an end view of the power connector system 100 mounted to the circuit card assembly 102. FIGS. 3 and 4 illustrates the circuit card 110 coupled to a card edge connector 150. Having the power connector system 100 supply power to the circuit card assembly 102 reduces the need for power transfer across the interface between the card edge connector 150 and the circuit card 110. As such, significantly more power can be transferred to the circuit card 110 than is possible if only the card edge connector is used to transmit power to the circuit card 110. Optionally, the power connector system 100 may entirely eliminate the need for power transfer across the interface between the card edge connector 150 and the circuit card 110.

Figure 5:
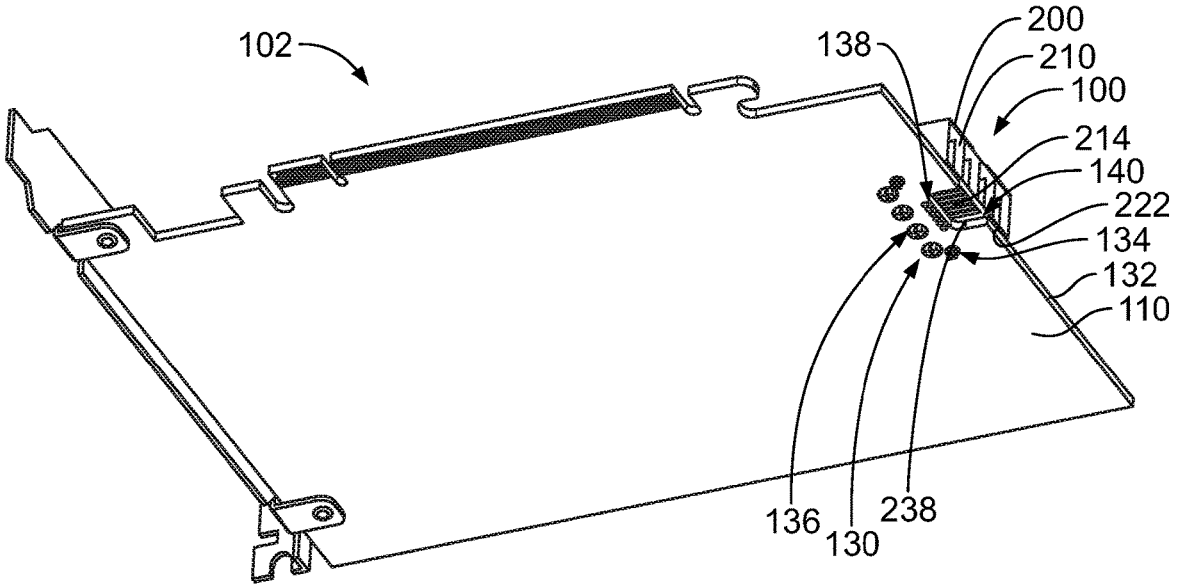
FIG. 5 is a bottom perspective view of the circuit card assembly illustrating a board power connector of the power connector system mounted to the circuit card in accordance with an exemplary embodiment.
Figure 6:
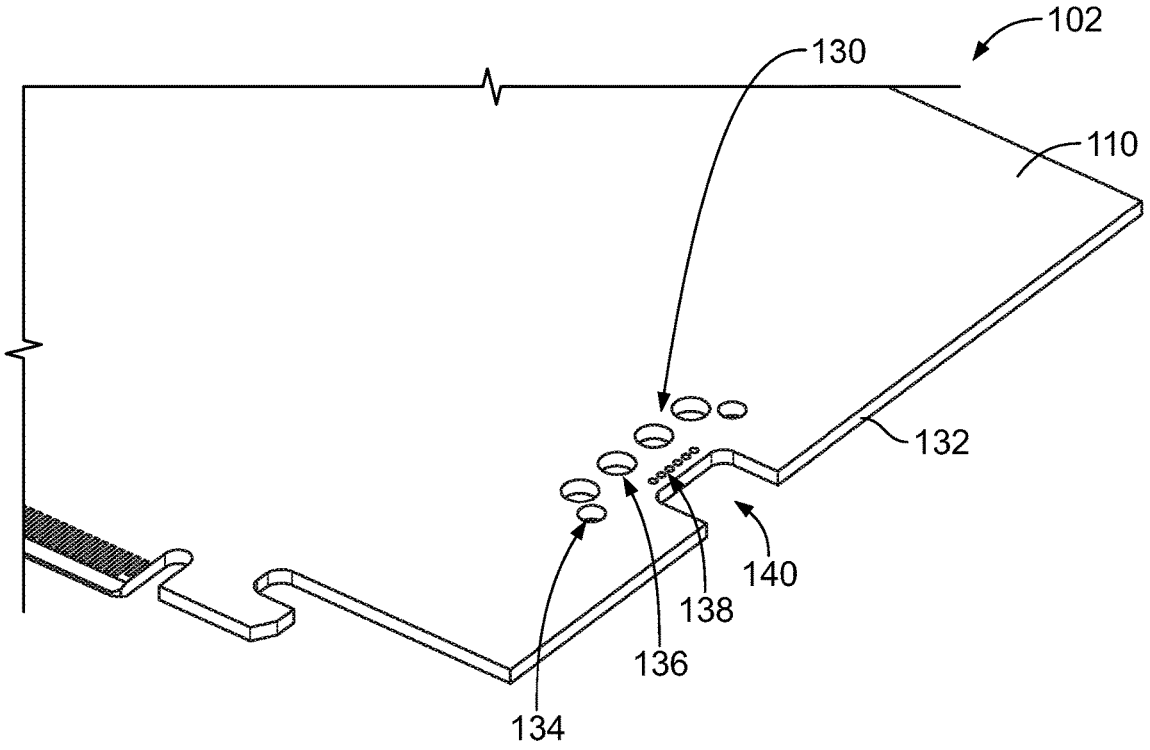
FIG. 6 is a top perspective view of a portion of the circuit card assembly in accordance with an exemplary embodiment.

FIG. 5 is a bottom perspective view of the circuit card assembly 102 illustrating the board power connector 200 mounted to the circuit card 110 in accordance with an exemplary embodiment. FIG. 6 is a top perspective view of a portion of the circuit card assembly 102 with the board power connector 200 removed for clarity. The circuit card 110 includes the power conductors 136 in the signal conductors 138 at the mounting area 130 along the side edge 132. The signal conductors 138 enhance the operation of the power connector system 100 by providing signal lines and signaling between the board power connector 200 and the circuit card 110. The signal lines may be used for coding to determine the type of cable power connector and power cable coupled to the board power connector 200. Optionally, the signaling may be used to control the flow of power through the power connector system 100. For example, the signal conductors 138 may be used as part of a sense circuit for controlling power supply to the circuit card assembly 102. The signal conductors 138 may be used for data communication between one or more components of the circuit card assembly 102 and a remote device or component such as but not limited to a power supply.

The window 140 is provided within the mounting area 130 such that the board power connector 200 may be mounted to the circuit card 110 proximate to the window 140. In an exemplary embodiment, the board power connector 200 covers the window 140 such that signal contacts of the board power connector 200 are exposed through the window 140. The mounting openings 134, within the mounting area 130, receive fasteners or tabs used to secure the board power connector 200 to the circuit card 110. In the illustrated embodiment, the power conductors 136 are defined by vias through the circuit card 110 that receive power contacts of the board power connector 200. In the illustrated embodiment, the signal conductors 138 are defined by vias through the circuit card 110 that receive signal contacts of the board power connector 200. In an exemplary embodiment, the signal conductors 138 are contained within the footprint of the board power connector 200. For example, the signal conductors 138 are positioned between the power conductors 136 and the edge 132. As such, the signal conductors 138 do not increase the overall footprint of the mounting area 130. The signal conductors 138 are contained within an area already dedicated to the board power connector 200 and thus the addition of the signal lines to the power connector system 100 and the circuit card assembly 102 to not add to the overall footprint or size of the mounting area 130. In various embodiments, the window 140 in the circuit card 110 encompasses some of the signal contact mass of the board power connector 200 and/or the cable power connector 300 to reduce connector footprint breadth on the top side of the circuit card 110 and reduces the depth of the connector mass below the circuit card bottom side to reduce airflow restrictions caused by the power connectors 200, 300.

Figure 7:
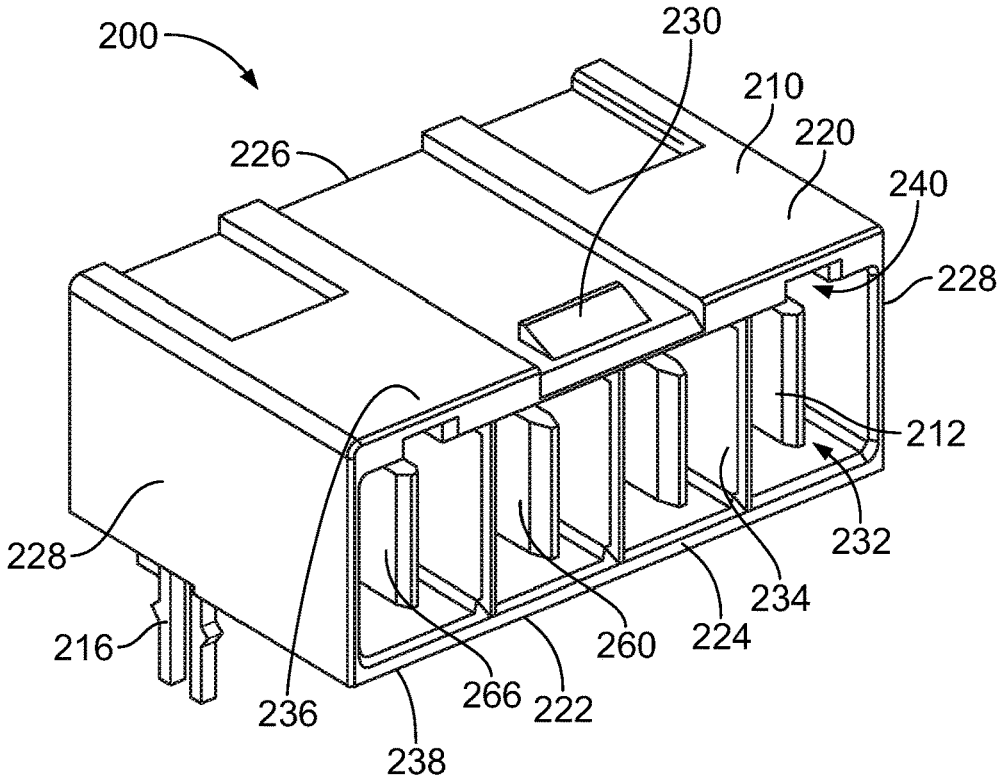
FIG. 7 is a top perspective view of the board power connector in accordance with an exemplary embodiment.
Figure 8:
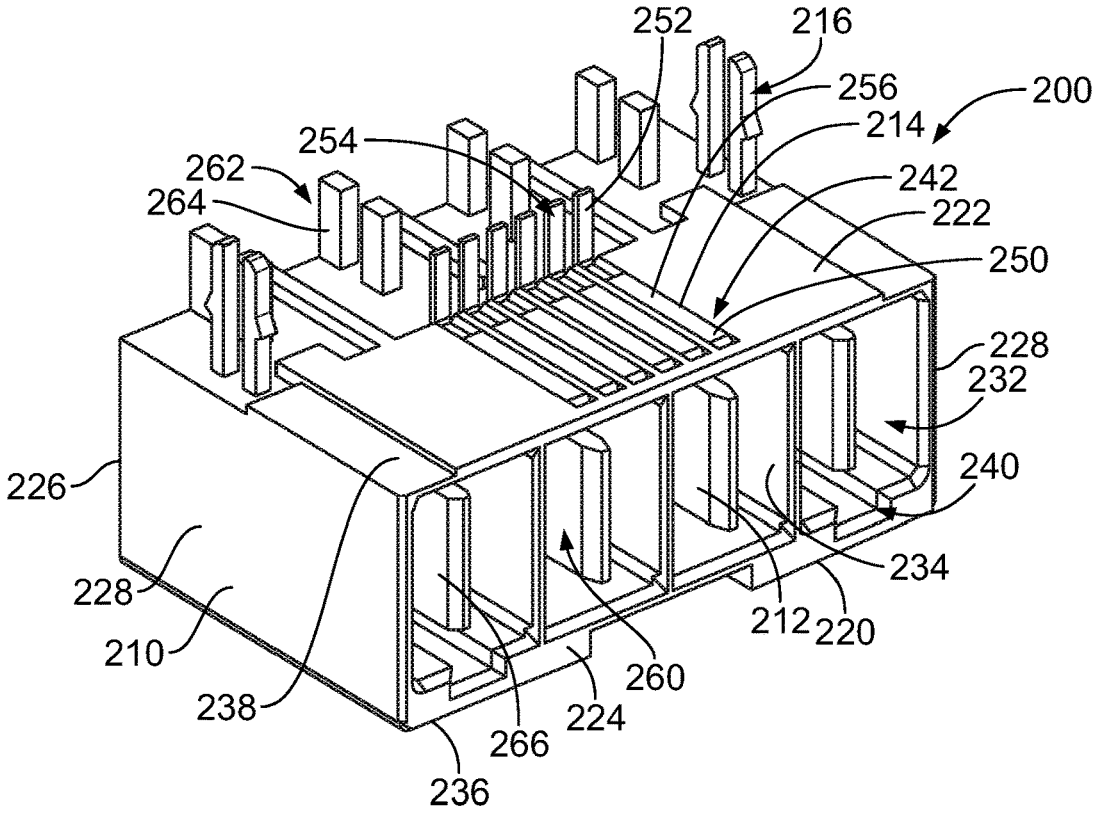
FIG. 8 is a bottom perspective view of the board power connector in accordance with an exemplary embodiment.

FIG. 7 is a top perspective view of the board power connector 200 in accordance with an exemplary embodiment. FIG. 8 is a bottom perspective view of the board power connector 200 in accordance with an exemplary embodiment. FIGS. 7 and 8 illustrate a mating interface of the board power connector 200, such as for mating with the cable power connector 300 (shown in FIG. 1). FIG. 8 illustrates a mounting interface of the board power connector 200, such as for mounting to the circuit card assembly 102 (shown in FIG. 1).

The board power connector 200 includes a board housing 210 holding board power contacts 212, board signal contacts 214 and mounting tabs 216 used for mounting the board power connector 200 to the circuit card 110. The board power contacts 212 are configured to be electrically connected to the circuit card assembly 102 and the cable power connector 300. The board signal contacts 214 are configured to be electrically connected to the circuit card assembly 102 and the cable power connector 300.

The board housing 210 is a dielectric housing, such as a plastic housing. The board housing 210 may be manufactured by a molding process to form the board housing 210. In an exemplary embodiment, the board housing 210 is box shaped. The board housing 210 includes a top 220 and a bottom 222 opposite the top 220. The board housing 210 includes a front 224 and a rear 226 opposite the front 224. The board housing 210 includes sides 228 extending between the top 220 and the bottom 222 and extending between the front 224 and the rear 226. The board housing 210 may have other shapes in alternative embodiments. The board housing 210 includes a latching feature 230 along the top 220 configured to interface with the latch 306 (shown in FIG. 1) to secure the cable power connector 300 to the board power connector 200. The latching feature 230 may be at other locations in alternative embodiments.

The board housing 210 includes cavities 232 that receive the board power contacts 212. The cavities 232 are open, such as at the front 224, to receive portions of the cable power connector 300. For example, the cable power connector 300 is configured to plug into the cavities 232 to electrically connect with the board power contacts 212. In the illustrated embodiment, the cavities 232 are rectangular shaped; however, the cavities 232 may have other shapes in alternative embodiments. The board housing 210 includes separating walls 234 between the cavities 232. The separating walls 234 extend between an upper wall 236 and a lower wall 238 of the board housing 210. The lower wall 238 extends along the bottom 222 and the upper wall 236 extends along the top 220. Optionally, one or more of the cavities 232 may include keying features 240 for keyed mating with the cable power connector 300. In the illustrated embodiment, the keying features 240 are grooves in the upper wall 236 open to the cavities 232.

In an exemplary embodiment, the board housing 210 includes signal contact channels 242 that receive corresponding board signal contacts 214. The board signal contacts 214 are held in the signal contact channels 242. In an exemplary embodiment, the signal contact channels 242 are provided in the lower wall 238 and are open at the bottom 222 to expose the board signal contacts 214 along the bottom 222 of the board housing 210. The signal contact channels 242 are located between the cavities 232 and the bottom 222. The signal contact channels 242 position the board signal contacts 214 between the board power contacts 212 and the circuit card 110. The signal contact channels 242 may be provided at other locations in alternative embodiments.

In an exemplary embodiment, the board signal contacts 214 are stamped and formed contacts. The board signal contacts 214 are configured to be received in corresponding signal contact channels 242. Each board signal contact 214 includes a mating end 250 and a terminating end 252. Optionally, the board signal contact 214 may be a right angle contact having the mating end 250 perpendicular to the terminating end 252. The mating end 250 is configured to be mated with the cable power connector 300. The terminating end 252 is configured to be terminated to the circuit card 110.

In an exemplary embodiment, the board signal contact 214 includes a solder tail 254 at the terminating end 252 configured to be soldered to the circuit card 110. In the illustrated embodiment, the solder tail 254 is configured to be through mounted to the circuit card 110, such as in a via of the circuit card 110. Alternatively, the solder tail 254 may be surface mounted to the circuit card 110. In other various embodiments, the terminating end 252 may include a compliant pin configured to be press-fit into the circuit card 110.

In an exemplary embodiment, the board signal contact 214 includes a beam 256 at the mating end 250. In various embodiments, the beam 256 is contained within the signal contact channel 242, such as within the envelope of the board housing 210. For example, the beam 256 may be generally co-planer with the bottom 222 of the board housing 210. In other various embodiments, the beam 256 may be a spring beam that is deflectable and is configured to extend below the bottom 222 for mating with the cable power connector 300. Optionally, the beams 256 of the board signal contacts 214 may have different lengths. For example, one or more of the beams 256 may be shorter and/or one or more of the beams 256 may be longer for sequenced mating with the cable power connector 300. For example, one of the board signal contacts 214 may be a sense contact having a shorter beam 256 that is configured to mate last and break first during mating with and unmating from the cable power connector 300. The sense contact may be used to activate and deactivate the power circuit of the power connector system 100.

The board power contacts 212 are located within corresponding cavities 232 for mating with the cable power connector 300. The board power contacts 212 extend from the board housing 210 for electrical connection to the circuit card 110. In an exemplary embodiment, each board power contact 212 extends between a mating end 260 and a terminating end 262. Optionally, the board power contact 212 may be a right angle contact having the mating end 260 perpendicular to the terminating end 262. The mating end 260 is configured to be mated with the cable power connector 300. The terminating end 262 is configured to be terminated to the circuit card 110.

In an exemplary embodiment, the board power contact 212 includes a solder tail 264 at the terminating end 262 configured to be soldered to the circuit card 110. In the illustrated embodiment, the solder tail 264 is configured to be through mounted to the circuit card 110, such as in a via the circuit card 110. Alternatively, the solder tail 264 may be surface mounted to the circuit card 110. In other various embodiments, the terminating end 262 may include a compliant pin configured to be press-fit into the circuit card 110.

In an exemplary embodiment, the board power contact 212 includes a blade 266 at the mating end 260. In various embodiments, the blade 266 is contained within the receptacle 232, such as within the envelope of the board housing 210. Optionally, the blade 266 is arranged within the receptacle 232 such that the cable power connector 300 is configured to mate two both sides of the blade 266. The blade 266 has a large surface area at both sides for electrical connection with the cable power connector 300.

Figure 9:
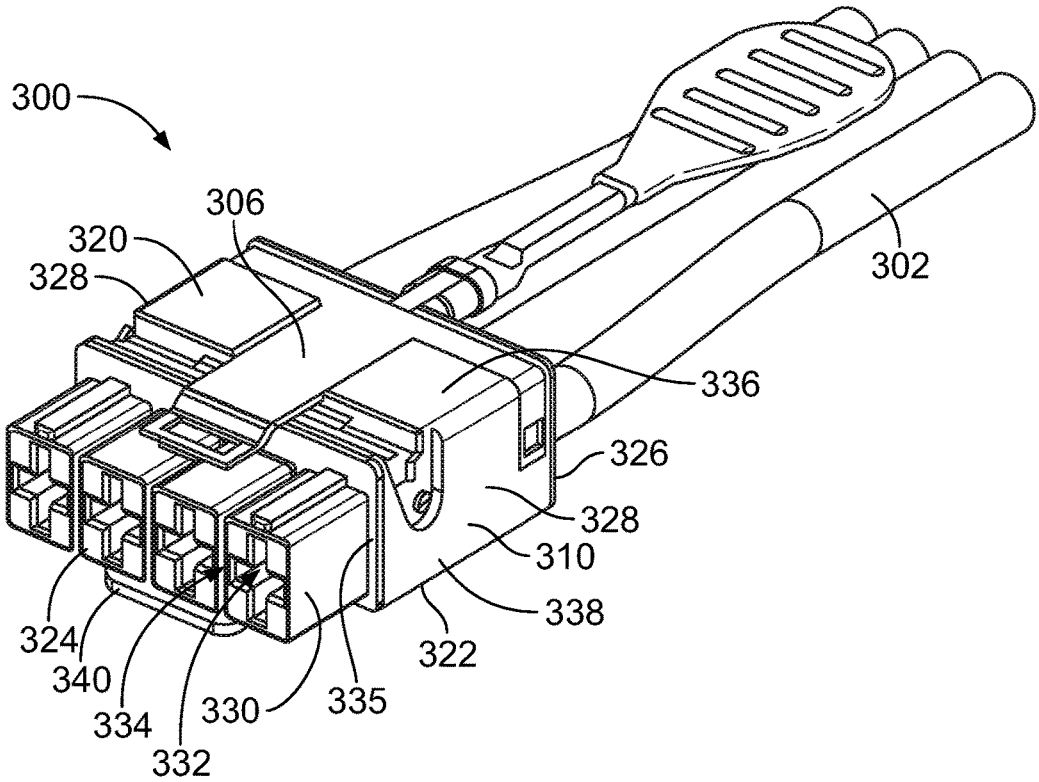
FIG. 9 is a front, top perspective view of a cable power connector of the power connector system in accordance with an exemplary embodiment.
Figure 10:
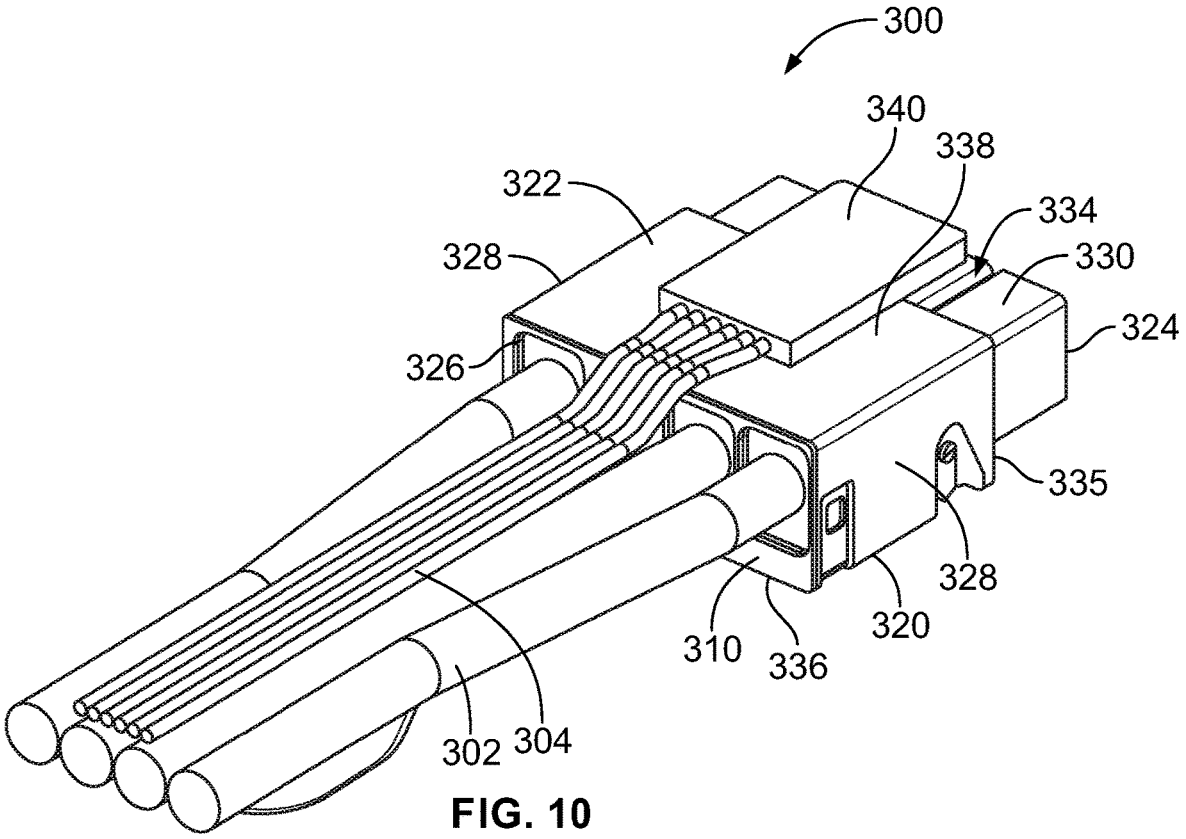
FIG. 10 is a rear, bottom perspective view of the cable power connector in accordance with an exemplary embodiment.
Figure 11:
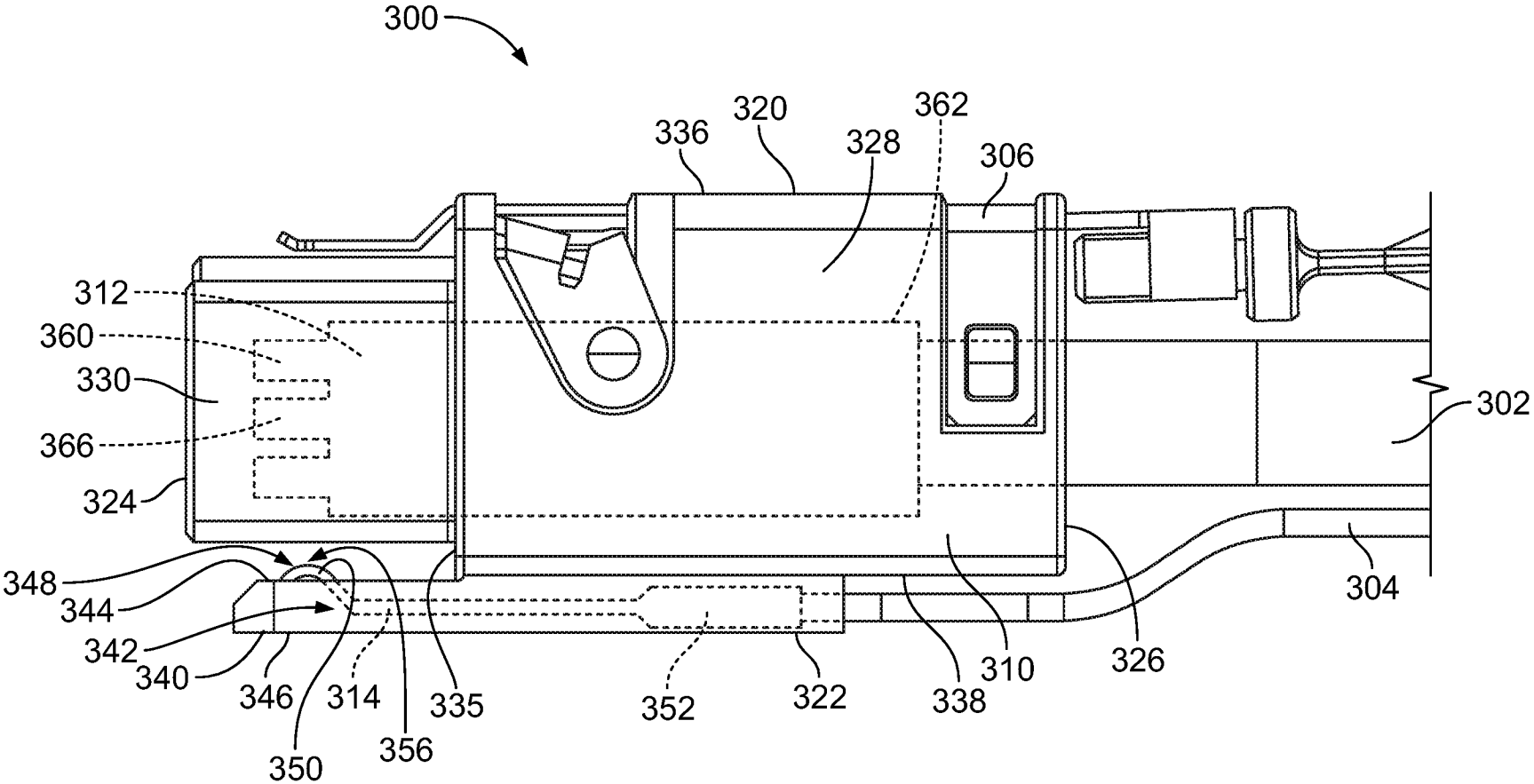
FIG. 11 is a side view of the cable power connector in accordance with an exemplary embodiment.

FIG. 9 is a front, top perspective view of the cable power connector 300 in accordance with an exemplary embodiment. FIG. 10 is a rear, bottom perspective view of the cable power connector 300 in accordance with an exemplary embodiment. FIG. 11 is a side view of the cable power connector 300 in accordance with an exemplary embodiment.

The cable power connector 300 includes a cable housing 310 holding cable power contacts 312 (shown in phantom in FIG. 11) and cable signal contacts 314 (shown in phantom in FIG. 11). The cable power contacts 312 are configured to be electrically connected to the power cables 302 and the board power contacts 212 (shown in FIG. 7). The cable signal contacts 314 are configured to be electrically connected to the signal cables 304 and the board signal contacts 214 (shown in FIG. 7).

The cable housing 310 is a dielectric housing, such as a plastic housing. The cable housing 310 may be manufactured by a molding process to form the plug housing 310. In an exemplary embodiment, the cable housing 310 is generally box shaped. The cable housing 310 includes a top 320 and a bottom 322 opposite the top 320. The cable housing 310 includes a front 324 and a rear 326 opposite the front 324. The cable housing 310 includes sides 328 extending between the top 320 and the bottom 322 and extending between the front 324 and the rear 326. The cable housing 310 may have other shapes in alternative embodiments. The cable housing 310 supports the latch 306 along the top 320 configured to interface with the latching feature 230 (shown in FIG. 7) to secure the cable power connector 300 to the board power connector 300.

The cable housing 310 includes contact silos 330 at the front 324. The contact silos 330 include contact channels 332 that receive the cable power contacts 312. The contact channels 332 are open at the front 324 to receive the board power contacts 212 (shown in FIG. 7) when the cable power connector 300 is mated with the board power connector 200. The contact silos 330 are sized and shaped to fit within corresponding cavities 232 (shown in FIG. 7) during mating to electrically connect the cable power contacts 312 with the board power contacts 212. In the illustrated embodiment, the contact silos 330 are rectangular shaped; however, the contact silos 330 may have other shapes in alternative embodiments. The cable housing 310 includes slots 334 between the contact silos 330. The slots 334 are configured to receive the separating walls 234 (shown in FIG. 7) of the board housing 210 when the contact silos 330 are plugged into the cavities 232. In an exemplary embodiment, the contact silos 330 extend forward from a base wall 335 that extends between an upper wall 336 and a lower wall 338 of the cable housing 310. The lower wall 338 extends along the bottom 322 and the upper wall 336 extends along the top 320. Optionally, one or more of the contact silos 330 may include keying features for keyed mating with the cable power connector 300. In the illustrated embodiment, the keying features are ribs extending along the contact silos 330, such as the tops of one or more of the contact silos 330.

In an exemplary embodiment, the cable housing 310 includes a platform 340 at the bottom 322 of the cable housing 310. The platform 340 is provided at the front 324 of the cable housing 310. The platform 340 supports the cable signal contacts 314. In an exemplary embodiment, the platform 340 includes signal contact channels 342 that receive corresponding cable signal contacts 314. The cable signal contacts 314 are held in the signal contact channels 342. The platform 340 has an upper surface 344 and a lower surface 346 opposite the upper surface 344. The lower surface 346 is provided at the bottom 322 of the cable housing 310 in various embodiments. The upper surface 344 faces the contact silos 330 across a gap 348. The platform 340 is spaced apart from the contact silos 330 by the gap 348. The gap 348 is open at the front 324 to receive the lower wall 238 (shown in FIG. 7) of the board housing 210 when the cable power connector 300 is mated with the board power connector 200. In an exemplary embodiment, the cable signal contacts 314 are provided at the upper surface 344 and extend into the gap 348 to interface with the board signal contacts 214 when the cable power connector 300 is mated with the board power connector 200. The cable signal contacts 314 are positioned between the board power contacts 312 and the bottom 322. The cable signal contacts 314 may be provided at other locations in alternative embodiments.

In an exemplary embodiment, the cable signal contacts 314 are stamped and formed contacts. Each cable signal contact 314 includes a mating end 350 and a terminating end 352. The mating end 350 is configured to be mated with the board signal contact 214 of the board power connector 200. The terminating end 352 is configured to be terminated to the signal cable 304. In an exemplary embodiment, the cable signal contact 314 includes a crimp barrel at the terminating end 352 configured to be crimped to the signal cable 304; however, the terminating end 352 may be terminated by other means in alternative embodiments. The signal cables 304 extend from the rear 326, such as from the rear of the platform 340.

In an exemplary embodiment, each cable signal contact 314 includes a spring beam 356 at the mating end 350 configured to be mated with the board signal contact 214. The spring beam 356 is deflectable and extends above the upper surface 344 to interface with the board signal contact 214. Optionally, the cable signal contacts 314 may have different lengths. For example, one or more of the cable signal contacts 314 may be shorter for sequenced mating with the board power connector 200. For example, one of the cable signal contacts 314 may be a sense contact positioning the spring beam 356 further from the front 324 to mate last and break first during mating with and un-mating from the board power connector 200. The sense contact may be used to activate and deactivate the power circuit of the power connector system 100.

The cable power contacts 312 are located within corresponding contact channels 332 for mating with the board power contacts 212 when the cable power connector 300 is mated with the board power connector 200. In an exemplary embodiment, each cable power contact 312 extends between a mating end 360 and a terminating end 362. The mating end 360 is configured to be mated with the corresponding board power contact 212. The terminating end 362 is configured to be terminated to the circuit card 110. In an exemplary embodiment, the terminating end includes a crimp barrel configured to be crimped to the corresponding power cable 302. In an exemplary embodiment, each cable power contact 312 includes spring beams 366 at the mating end 360 for mating with the corresponding board power contact 212. Optionally, each board power contact 212 includes a plurality of spring beams 366 for mating with the board power contact 212. The spring beams 366 may be configured to engage both sides of the board power contact 212 for electrical connection with the cable power connector 300.

Returning to FIG. 4, FIG. 4 illustrates the cable power connector 300 mated to the board power connector 200. The cable housing 310 is generally located above the top surface 112 of the circuit card 110. The platform 340 at the bottom 322 of the cable housing 310 is received in the window 140. The signal cables 304 and the cable signal contacts 314 do not add to the overall footprint of the power connector system 100 on the circuit card 110. The cable power connector 300 with the addition of the signal cables 304 and the cable signal contacts 314 remains low-profile and contained within the footprint of the cable housing 310 needed for the power cables 302 and the cable power contacts 312.

With additional reference to FIG. 5, the platform 340 is received in the window 140 to electrically connect the cable signal contacts 314 with the board signal contacts 214 at the bottom 222 of the board housing 210. As the cable power connector 300 is mated to the board power connector 200, the lower wall 238 of the board housing 210 is received in the gap 348 between the platform 340 and the contact silos 330. The cable signal contacts 314 on the upper surface 344 of the platform 340 interface with the board signal contacts 214 at the bottom 222 of the board housing 210.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. A power connector system for a circuit card assembly, the power connector system comprising:

a board power connector having a board housing including a top, a bottom, a front and a rear, the board housing including cavities open at the front, the bottom configured to be mounted to a circuit card of the circuit card assembly, the board housing including signal contact channels on the bottom, the board power connector including board power contacts received in corresponding cavities, each board power contact including a mating end and a terminating end, the terminating ends of the board power contacts configured to be terminated to the circuit card, the board power connector including board signal contacts received in corresponding signal contact channels, each board signal contact including a mating end and a terminating end, the terminating ends of the board signal contact configured to be terminated to the circuit card, the mating ends of the board signal contacts being exposed along the bottom of the board housing; and a cable power connector configured to be mated to the board power connector, the cable power connector having a cable housing including a top, a bottom, a front and a rear, the cable power connector including power cables extending from the rear, the cable housing including contact silos at the front, the cable power connector including cable power contacts held in corresponding contact silos, the cable power contacts being terminated to corresponding power cables, the contact silos and the cable power contacts being received in the cavities of the board housing to mate the cable power contacts with the board power contacts, the cable power connector including cable signal contacts arranged at the bottom of the cable housing outside of the contact silos for mating with the board signal contacts when the cable power connector is mated with the board power connector.

2. The power connector system of claim 1, wherein the signal contact channels are open at the bottom of the board housing to expose the mating ends of the board signal contacts along the bottom of the board housing.

3. The power connector system of claim 1, wherein the board signal contacts are outside of the cavities of the board housing.

4. The power connector system of claim 1, wherein the mating ends of the board signal contacts are coplanar with the bottom of the board housing.

5. The power connector system of claim 1, further comprising a circuit card having a mounting area with a window through the circuit card in the mounting area, the bottom of the board housing being mounted to the circuit card at the mounting area, the mating ends of the board signal contacts being exposed through the window.

6. The power connector system of claim 5, wherein the circuit card includes a card edge having contact pads, the card edge being configured to be loaded into a slot of a card edge connector.

7. The power connector system of claim 5, wherein the cable signal contacts are received in the window.

8. The power connector system of claim 5, wherein the cable housing includes a platform at the bottom of the cable housing supporting the cable signal contacts, the platform being received in the window.

9. The power connector system of claim 1, wherein the cable housing includes a platform at the bottom of the cable housing, the platform being spaced apart from the contact silos with a gap therebetween, the mating ends of the cable signal contacts being exposed in the gap, the gap receiving the bottom of the board housing to mate the board signal contacts with the cable signal contacts.

10. The power connector system of claim 1, wherein the cable housing includes a platform extending along the contact silos, the platform including an upper surface and a lower surface, the lower surface provided at the bottom of the cable housing, the upper surface facing the contact silos across a gap, the cable signal contacts including mating ends along the upper surface for mating with the board signal contacts at the bottom of the board housing.

11. The power connector system of claim 1, wherein the cable signal contacts are coplanar with a circuit card of the circuit card assembly.

12. A power connector system for a circuit card assembly, the power connector system comprising:

a board power connector configured to be mounted to a circuit card of the circuit card assembly and configured to be mated with a cable power connector, the board power connector comprising:

a board housing including a top, a bottom opposite the top, a front extending between the top and the bottom, and a rear opposite the front and extending between the top and the bottom, the board housing including cavities open at the front, the bottom configured to be mounted to the circuit card of the circuit card assembly, the board housing including signal contact channels on the bottom having openings at the bottom;

board power contacts received in corresponding cavities, each board power contact including a mating end and a terminating end, the terminating ends of the board power contacts configured to be terminated to the circuit card, the mating ends of the board power contacts configured to be mated to cable power contacts of the cable power connector;

board signal contacts received in corresponding signal contact channels, each board signal contact including a mating end and a terminating end, the terminating ends of the board signal contacts configured to be terminated to the circuit card, the mating ends of the board signal contacts located at or below the bottom of the board housing and passing into or through the openings at the bottom of the board housing, the mating ends of the board signal contacts being exposed along the bottom of the board housing for mating with cable signal contacts of the cable power connector;

wherein the mating ends of the board power contacts are configured to be mated with the cable power contacts at an interior of the board power connector and wherein the mating ends of the board signal contacts are configured to be mated with the cable signal contacts at an exterior of the board power connector.

13. The power connector system of claim 12, wherein the signal contact channels are open at the bottom of the board housing to expose the mating ends of the board signal contacts along the bottom of the board housing.

14. The power connector system of claim 12, wherein the board signal contacts are outside of the cavities of the board housing.

15. The power connector system of claim 12, wherein the mating ends of the board signal contacts are coplanar with the bottom.

16. The power connector system of claim 12, further comprising a circuit card having a mounting area with a window through the circuit card in the mounting area, the bottom of the board housing being mounted to the circuit card at the mounting area, the mating ends of the board signal contacts being exposed through the window.

17. The power connector system of claim 16, wherein the circuit card includes a card edge having contact pads, the card edge being configured to be loaded into a slot of a card edge connector.

18. A power connector system for a circuit card assembly, the power connector system comprising:

a cable power connector configured to be mated to a board power connector mounted to the circuit card assembly, the cable power connector comprising:

a cable housing including a top, a bottom, a front and a rear, the cable housing including contact silos at the front configured to be received in cavities of the board power connector, the cable housing including a platform at the bottom spaced apart from the contact silos by a gap, the gap configured to receive a bottom wall of a board housing of the board power connector;

cable power contacts held in corresponding contact silos and configured to be received in the cavities of the board power connector with the contact silos, the cable power contacts including mating ends configured to be mated to board power contacts of the board power connector, the cable power contacts including terminating ends;

power cables terminated to the terminating ends of the cable power contacts and extending from the rear;

cable signal contacts arranged at the bottom of the cable housing along the platform, the cable signal contacts including mating ends and terminating ends, the mating ends being exposed along the platform for mating with board signal contacts of the board power connector; and signal cables terminated to terminating ends of the cable signal contacts.

19. The power connector system of claim 18, wherein the platform includes an upper surface and a lower surface, the lower surface provided at the bottom of the cable housing, the upper surface facing the contact silos across the gap, the cable signal contacts including mating ends along the upper surface for mating with the board signal contacts.

20. The power connector system of claim 1, wherein the cable signal contacts are coplanar with a circuit card of the circuit card assembly.

* * * * *